United States Patent [19]

Bullock, III

[11] Patent Number: 4,729,488

[45] Date of Patent: Mar. 8, 1988

[54] TAMPER-EVIDENT COVER FOR THREADED NECK

[75] Inventor: Joseph J. Bullock, III, Atherton, Calif.

[73] Assignee: Bankers Trust Co., New York, N.Y.

[21] Appl. No.: 896,283

[22] Filed: Aug. 14, 1986

[51] Int. Cl.[4] ..... B65D 41/18

[52] U.S. Cl. ..... 215/256; 215/31; 220/270; 220/276

[58] Field of Search ..... 215/256, 253, 254, 258, 215/31, 1 R; 220/270, 276; 138/89, 96 R

[56] References Cited

U.S. PATENT DOCUMENTS

| | | | |
|---|---|---|---|
| 2,926,806 | 3/1960 | Streng et al. | 215/256 |
| 3,120,900 | 2/1964 | Faulstich | 215/256 |
| 3,283,935 | 11/1966 | Samuels et al. | 215/256 |
| 4,202,455 | 5/1980 | Faulstich | 215/31 |
| 4,307,821 | 12/1981 | McIntosh | 220/270 |
| 4,496,066 | 1/1985 | Bullock, III | 215/31 |
| 4,522,308 | 6/1985 | Sullivan | 215/253 |

*Primary Examiner*—Stephen Marcus
*Assistant Examiner*—Nova Stucker

[57] ABSTRACT

Liquified and compressed gases are sold in cylinders having threaded necks which attach to lanterns, stoves, torches, etc., which use the gas as fuel. A tearable plastic cap fits over the neck and has an internal bead which snaps under a shoulder on the neck. Above the shoulder is a circumferential first score line and a second score line extends to the bottom of the cap. In proximity to the second score line is a pull tab. Before the tab is pulled, the cap prevents surreptitious dispensing of the gas, protects the threads and prevents contamination of the neck and of the valve inside the neck. To remove the cap, the tab is pulled, tearing the cap along the second and then the first score line, thereby removing the lower portion of the cap, including the bead. The upper portion of the cap may be used for reclosure.

2 Claims, 3 Drawing Figures

TAMPER-EVIDENT COVER FOR THREADED NECK

BACKGROUND OF THE INVENTION

1. Field of the Invention

This invention relates to a new and improved tamper-evident cover for threaded necks of cylinders of the type used in the sale of propane, butane and LP gases. More particularly, the invention relates to a cover which fits over the threaded end of a neck to protect the same against damage to the threads, unintentional accidental opening of the valve located in the neck to release gas and/or tampering.

2. Description of Related Art

Heretofore commercially available necks of the type used on such containers have been protected by dust covers consisting of discs having cylindrical skirts which fit over the neck and are held in place by friction. The present invention provides numerous advantages over such covers as hereinafter explained.

Container caps of the general type herein described are shown in such references as U.S. Pat. No. 3,120,900. The present invention has advantages over such closures as well.

SUMMARY OF THE INVENTION

A heavy walled, pressurized container used for supplying gas for portable stoves, lanterns, torches and the like is provided with a neck in which a dispensing valve is located. This valve is opened when the cylinder is properly connected to the device with which it is to be used. The upper end of the neck has an annular flat surface. The exterior of the neck has screw threads spaced downwardly from the outer end of the neck. Below the threads is a shoulder extending inward to a neck which projects up from the top of the cylindrical container.

The cap of the present invention has a top disc which fits against the outer end of the neck and a peripheral upper skirt which surrounds the portion of the neck above the threads. The lower portion of the skirt covers the threads and has an internal bead which snaps under the shoulder and normally retains the cap in place and prevents, or at least provides evidence of, tampering. To remove the cap, there is a circumferential horizontal score line formed in the lower portion of the skirt connected to a downwardly extending second score line which extends to the bottom of the skirt. Adjacent the second score line is a pull tab which may be gripped by the user and when pulled tears the cap first along the second score line and then around the first score line, removing the bottom portion of the skirt including the bead aforesaid. Thereupon the upper portion of the cap functions as a reclosure cap. The cap is so constructed that the bottom edge of the skirt rests upon the top of the cylinder and the tab is bent extending outward so that it may be conveniently grasped.

Other objects of the present invention will become apparent upon reading the following specification and referring to the accompanying drawings in which similar characters of reference represent corresponding parts in each of the several views.

DESCRIPTION OF THE PREFERRED EMBODIMENTS

Figure 2:
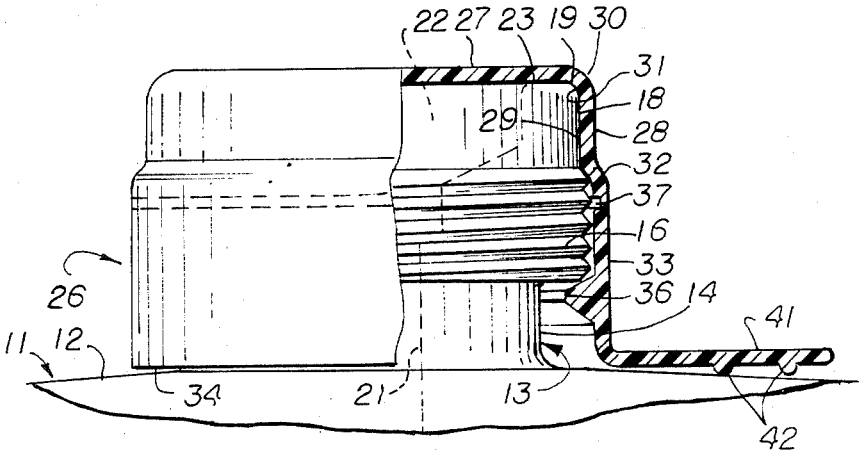
FIG. 2 is an enlarged sectional view taken substantially along the line 2—2 of FIG. 1 showing the cap installed upon the neck of a gas cylinder.

In FIG. 2 is shown the upper portion of a cylinder 11 in which pressurized gases of the type heretofore described are packaged. There is a horizontal ledge 12 at the top of the cylinder 11 from which projects upwardly neck 13. The lower portion 14 of neck 13 is cylindrical and extends to a larger diameter threaded portion 16, there being a horizontal shoulder 17 below the threaded portion 16. Above the threaded portion 16 is a reduced diameter cylindrical portion 18 having a rounded corner 19 at its upper end. Neck 13 has an internal throat 21 formed with a larger diameter internal bore 22 in which a dispensing valve (not shown) is installed as well understood in this art. The details of the shape of the bore 22 form no part of the present invention. On the outer end of the neck 13 is a horizontal lip 23 extending outward from the upper end of the bore 22 to the corner 19.

Cap 26 of the present invention has a flat top disc 27, the lower surface of which engages the lip 23. Below disc 23 is a rounded corner 30, the inner surface of which engages the corner 19 and below the corner 30 is a cylindrical upper skirt 28, the internal wall 29 of which snugly engages the portion 18 of the neck 13. Below upper skirt 28 is an S-curved transition section 32 and below that is cylindrical lower skirt 33 of larger diameter than portion 28. The bottom edge 34 of skirt 33 rests upon the ledge 12. Internal bead 36 fits under the shoulder 17. Thus when the cap is applied to the neck 13, the skirt 33 stretches until the bead 36 snaps under the shoulder 17. When thus in place, the cap cannot be removed without providing evidence of tampering. Bead 36 may be continuous around the circumference of skirt 33 or it may be interrupted, as is shown in such references as U.S. Pat. No. 4,202,455.

When the cap 26 is in place on the neck 13 as shown in FIG. 2, it prevents dirt from entering in the bore 32. It also prevents any object from accidentally entering the bore 32 and opening the dispensing valve which is located therein. In addition, the cap 26 prevents a dishonest person from using all or part of the contents of the container and then selling it as a full container.

Figure 1:
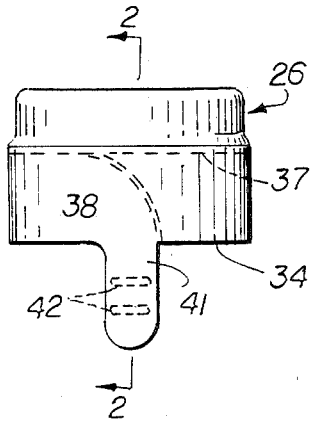
FIG. 1 is a side elevational view of one form of cap embodying the present invention.

As best shown in FIG. 1, there is a horizontal circumferential first internal score line 37 near the upper end of the lower skirt portion 33 which connects with a downwardly curved second score line 38 which extends to the bottom edge 34. As shown in FIG. 1, this score line 38 curves toward the right. It will be understood, however, that it could also be constructed so that it curves to the left. Adjacent the lower edge of score line 38 is a pull tab 41 which may be formed with gripping ribs 42. Since the bottom edge 34 rests on the shoulder 12, as best shown in FIG. 2, the tab 41 extends outwardly along the ledge 12 and because of the ribs 42, is spaced above the ledge 12 to facilitate grasping the tab. The ribs 42 also improve the grip of the user on the tab. The user, therefore, pulls the tab 41 upward, along the second score line 38 and thence around the first score line 37, removing most of the bottom skirt portion 33, including particularly the bead 36. Thereafter the upper end of the cap 26 may be removed and may subsequently be reused as a re-closure cap if this should become desirable. Since tearing the score lines 38 and 37 gives evidence of tampering, the cap is tamper-evident.

Figure 3:
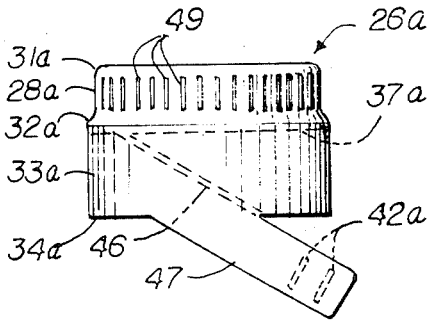
FIG. 3 is a view similar to FIG. 1 of a modification.

FIG. 3 shows a modification wherein the second score line extends downwardly to bottom edge 34*a* at a slant and the tab 47 also extends at a slant, the upper edge of tab 47 constituting an extension of the score line 46. Here again, although as shown in FIG. 3 the score line 46 slants downward to the right, it could also slant to the left.

As shown in FIG. 3 there are external flutes 49 which comprise spaced vertical external ribs in the upper skirt portion 28. Such ribs 49 facilitate gripping the reclosure cap. They also permit expansion of the upper skirt portion 28*a* so that, by reason of its resilient characteristics, it may tightly grip the reduced diameter portion 18. In other respects the cap of FIG. 3 denominated 26*a* resembles that of FIG. 1 and the same reference numerals followed by the subscript a are used to designate corresponding parts.

What is claimed is:

1. In combination, a container having a neck formed with a top lip, a vertical cylindrical exterior below said lip, a vertical threaded portion of greater diameter than said cylindrical portion below said cylindrical portion and a vertical reduced diameter portion below said threaded portion of lesser diameter than said cylindrical portion, a shoulder below said threaded portion, and a horizontal annular ledge below said neck, said cap comprising a top disk and a peripheral depending skirt fitting tightly around at least portions of the exterior of said neck, said skirt having an upper portion having an internal diameter to fit tightly against said cylindrical portion and a lower portion having one internal diameter to fit tightly against said threaded portion and a transition portion between said upper and lower portions, said skirt having an internal bead spaced upward from its lower edge fitting under said shoulder, said skirt being formed with tear means, said tear means comprising a horizontal first score line at a level near the top of the threaded portion of said neck, a second score line extending down to the bottom of said skirt and a tab extending beyond the bottom of said skirt adjacent said second score line whereby by pulling away said tear means the lower portion of said skirt including said internal bead may be torn off said skirt, said lower portion of said cap skirt having a length such that its lower edge fits tight against said ledge, said tab extending horizontally along said ledge.

2. A cap according to claim 1 in which said tab is formed with a plurality of transverse ridges, said ridges being capable of resting on said ledge with said tab being slightly elevated above said ledge.

* * * * *